US005165376A

United States Patent [19]

Klejeski et al.

[11] Patent Number: 5,165,376

[45] Date of Patent: Nov. 24, 1992

[54] TAPERED GOVERNOR ARM/GOVERNOR SHAFT JOINT

[75] Inventors: Anthony T. Klejeski, Bethel; Curtis D. Leaf, Blaine, both of Minn.

[73] Assignee: Onan Corporation, Minneapolis, Minn.

[21] Appl. No.: 828,408

[22] Filed: Jan. 31, 1992

[51] Int. Cl.[5] ..... F02D 9/00

[52] U.S. Cl. ..... 123/376

[58] Field of Search ..... 123/373, 374, 376, 400; 403/4, 253

[56] References Cited

U.S. PATENT DOCUMENTS

| | | | |
|---|---|---|---|
| 913,121 | 2/1909 | Frayer | 123/376 |
| 1,524,445 | 1/1924 | Manicki | 123/376 |
| 1,623,655 | 4/1927 | Brown | 123/376 |
| 2,193,724 | 3/1940 | Horton | 403/253 |
| 4,624,596 | 11/1986 | Eckendorff | 403/4 |
| 5,069,180 | 12/1991 | Schmid et al. | 123/376 |

*Primary Examiner*—Tony M. Argenbright
*Attorney, Agent, or Firm*—Merchant, Gould, Smith, Edell, Welter & Schmidt

[57] ABSTRACT

An apparatus for use as a governor arm/governor shaft joint in a governor system (10) and a method for zeroing out the tolerances in a governor system (10) used in reciprocating internal combustion engines. The apparatus is comprised of a governor shaft (12) with first and second ends having a tapered portion (21) located near said first end; a governor arm (13) with first and second ends having a tapered aperture (29) generally located near said first end that is arranged and configured to match the tapered portion (21) of the governor shaft (12); and a securing element (31) that forces the tapered portion (21) into engagement with the tapered aperture (29). The tolerances in the governor system (10) are zeroed by rotating the governor shaft (12) to its maximum position; loosely placing the tapered aperture (29) of the governor arm (13) on the governor shaft (12), attaching a linkage (14) between the governor arm first aperture (24) and the carburetor valve (15), attaching a governor spring (16) between a control plate (17) and a second governor arm aperture (26) whereby said governor spring (16) is arranged and configured to rotate the governor arm (13) until the carburetor valve (15) is in its maximum open position, and applying a securing element (31) that forces the tapered portion (21) into engagement with the tapered aperture (29).

9 Claims, 3 Drawing Sheets

TAPERED GOVERNOR ARM/GOVERNOR SHAFT JOINT

FIELD OF THE INVENTION

This invention relates to governor assemblies for use on small engines and more particularly to the joint connecting the governor shaft to the governor arm.

BACKGROUND OF INVENTION

Many reciprocating internal combustion small engines utilize a governor system to regulate the relationship between carburetor position and engine speed to maintain a constant speed at varying loads. These systems are usually comprised of an internal governor located inside the engine block, a governor shaft that interacts with the internal governor and extends outside the engine block, a governor arm attached to the governor shaft, a linkage between the governor arm and the carburetor valve and a governor spring attached to the governor arm and control plate. When properly assembled, the system balances the forces exerted by the internal governor on the governor shaft with the forces exerted by the spring on the governor arm to achieve the proper relationship between carburetor position and engine speed.

Two major requirements arise with a system of this type. First, the governor arm must be capable of infinite adjustability relative to the governor shaft. Otherwise, the accumulation of design tolerances in the system components could affect the alignment of the governor arm relative to governor shaft position. Each one degree angle change in governor arm position can cause a significant change in the power of the engine. Therefore, all design tolerances must be zeroed out during the assembly of the governor system.

Second, the position of the governor arm relative to the governor shaft must remain fixed during the operation of the engine. During engine operation, the internal governor exerts forces on the governor shaft in a direction opposite to the forces exerted by the governor spring on the governor arm. Therefore, the joint between the governor arm and governor shaft must be capable of carrying the torque created by these opposing forces.

The current governor arm/governor shaft joint used throughout the small engine industry is shown in FIG. 1. The governor arm 13 is made of sheet metal and has two legs, one for connecting a governor spring and one for connecting a linkage to the carburetor. At the intersection of the two legs, the sheet metal governor arm is bent 180° to create a sleeve for the insertion of a bolt. An aperture arranged and configured to allow the insertion of the governor shaft 12 is located near the intersection of the two legs. A "V-shaped" notch is then cut from the bent portion to the aperture, enabling the bent portion to be compressed and the aperture to become smaller. A plate and washer having apertures for inserting a bolt are placed on the top and bottom of the bent portion and the bolt is inserted. A nut is tightened on the bolt compressing the bent portion and reducing the size of the aperture, securing the governor arm to the governor shaft.

The current governor arm/governor shaft joint does provide the infinite adjustability that is required when assembling the governor system, however, it requires three hands to complete the assembly. One hand must hold the governor shaft position, while two more hands are needed to secure the bolt/nut assembly. In addition, because the joint's torque carrying capacity is limited by the ability of the sheared metal edges of the sheet metal governor arm to grip the governor shaft, the existing design has limited torque carrying capacity which can limit governor design parameters.

Therefore, there arises a need for governor arm/governor shaft joint with increased torque carrying capacity and infinite adjustability that will simplify the assembly of the governor system and the zeroing of design tolerances.

BRIEF SUMMARY OF INVENTION

The present invention is for an apparatus for attaching a governor arm to a governor shaft and a method for zeroing out tolerances in a governor system. The invention is comprised of a governor shaft having a tapered portion located near the end of the governor shaft that will be attached to a governor arm having a corresponding tapered aperture. The tapered portion is inserted into the tapered aperture and the governor arm and governor shaft are then secured together by any suitable means that forces the tapered portion into engagement with the tapered aperture.

The use of this tapered design increases the torque carrying capacity of the joint by increasing the contact surface area between the governor arm and governor joint. The tapered joint design also contains the infinite adjustability feature required by the system. The use of the tapered surfaces allows the governor arm to be rotated to an infinite number of positions upon the governor shaft to assure that the design tolerances in the governor system components have been zeroed out. After the governor arm is properly positioned, any suitable securing means that forces the tapered portion into engagement with the tapered aperture can be used to secure the governor arm to the governor shaft.

In addition, the use of the tapered joint design simplifies the assembly of the governor system and the zeroing of design tolerances. First, the governor arm is loosely placed on the governor shaft which has been rotated to its maximum speed position. The governor spring is then attached causing the governor arm to rotate until the carburetor valve has reached its maximum open position and a single hand can be used to apply a securing means that forces the tapered portion into engagement with the tapered aperture.

DETAILED DESCRIPTION OF THE PREFERRED EMBODIMENT

Figure 3:
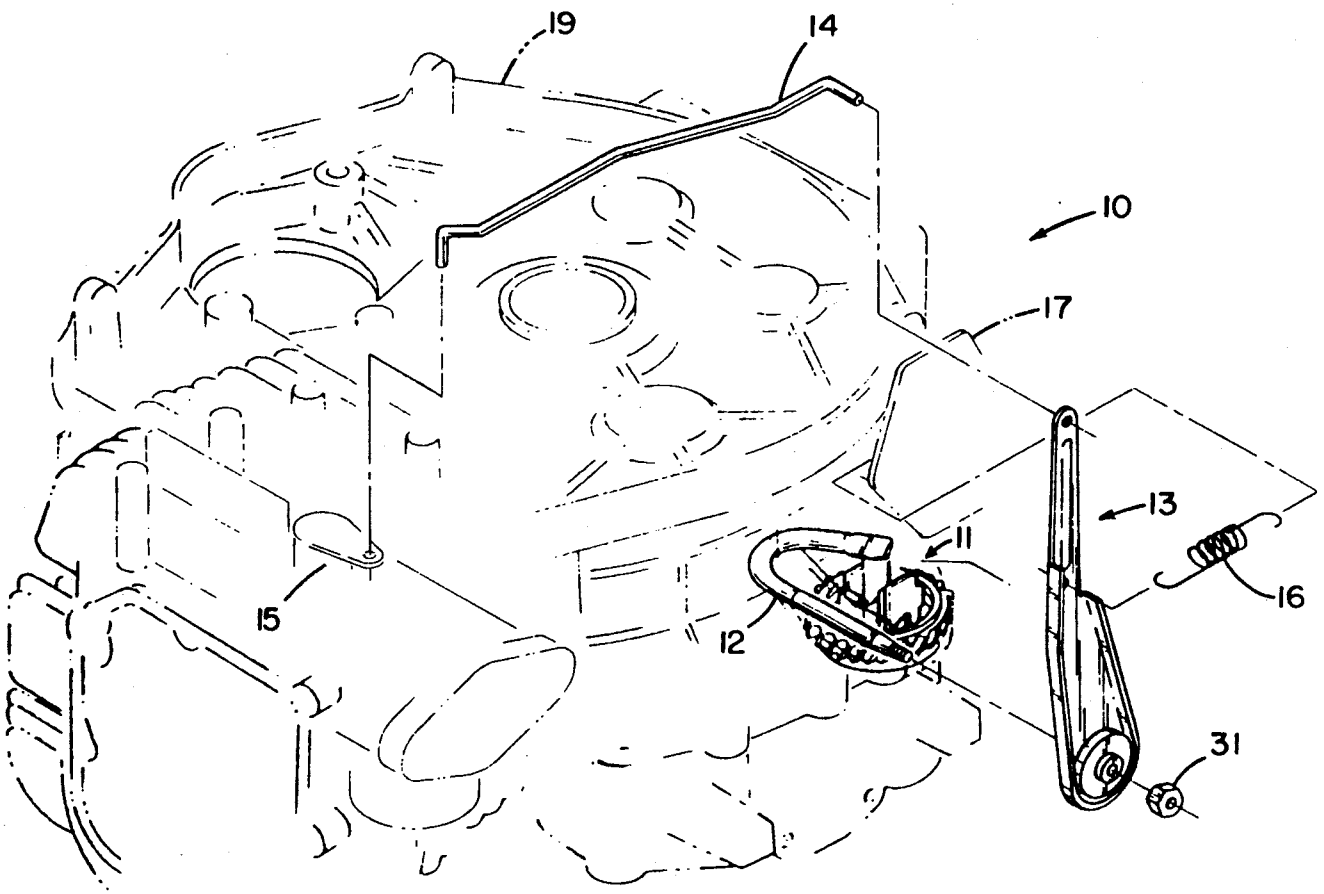
FIG. 3 is an exploded view of a governor system using the preferred embodiment of the invention with a phantom drawing of an engine to show the approximate positions of the governor system components.

Referring to the drawings where like numerals designate like parts, the preferred embodiment of the invention is a tapered governor arm/governor shaft joint for use in a governor system 10, best shown in FIG. 3, of a reciprocating internal combustion engine. For descriptive purposes, the preferred embodiment of the invention will be described in light of its proposed use on the Onan E125V engine. The governor system 10 is comprised of an internal governor 11, a governor shaft 12, a governor arm 13, a linkage 14 connecting the governor arm 13 to the carburetor valve 15 and a governor spring 16 connecting the governor arm 13 to the engine control plate 17.

Because the governor system 10 operates identically to those used throughout the small engine industry, only a brief description of the governor system's 10 operation is provided. The governor shaft 12 is inserted into the engine block 19 whereby one end of the governor shaft 12 is on the interior of the engine and contacts the internal governor 11 and the other end of the governor shaft 12 extends outside the engine and is attached to the governor arm 13. One end of the governor arm 13 is then attached to the governor shaft 12 and the other end of the governor arm 13 is attached to the linkage 14 to the carburetor valve 15. As engine speed varies, the internal governor 11 causes the governor shaft 12 to rotate through several degrees. Therefore, as the governor shaft 12 rotates, the governor arm 13 varies carburetor valve position 15 relative to engine speed, enabling the engine to maintain a constant speed at varying loads. The governor spring 16 is attached between the governor arm 13 and the control plate 17 and acts to balance the internal governor 11 forces to maintain the preset speed.

Figure 1:
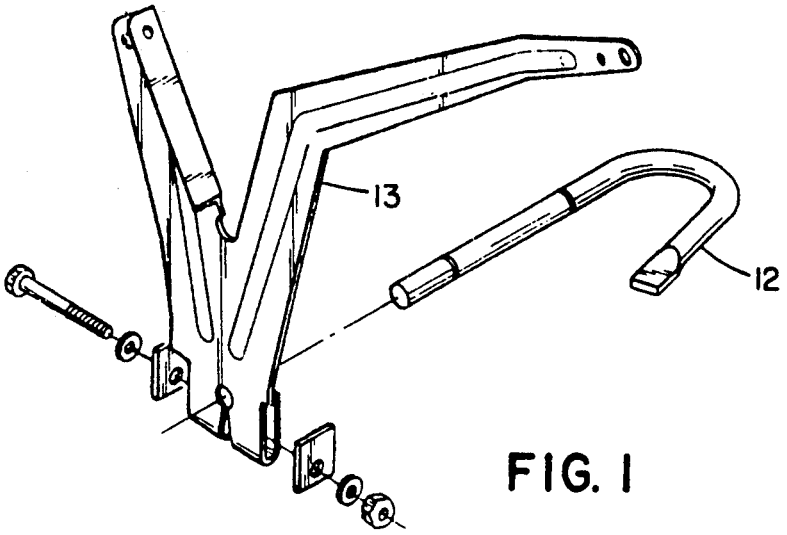
FIG. 1 is an exploded view of the current governor arm/governor shaft joint used throughout the small engine industry.
Figure 2:
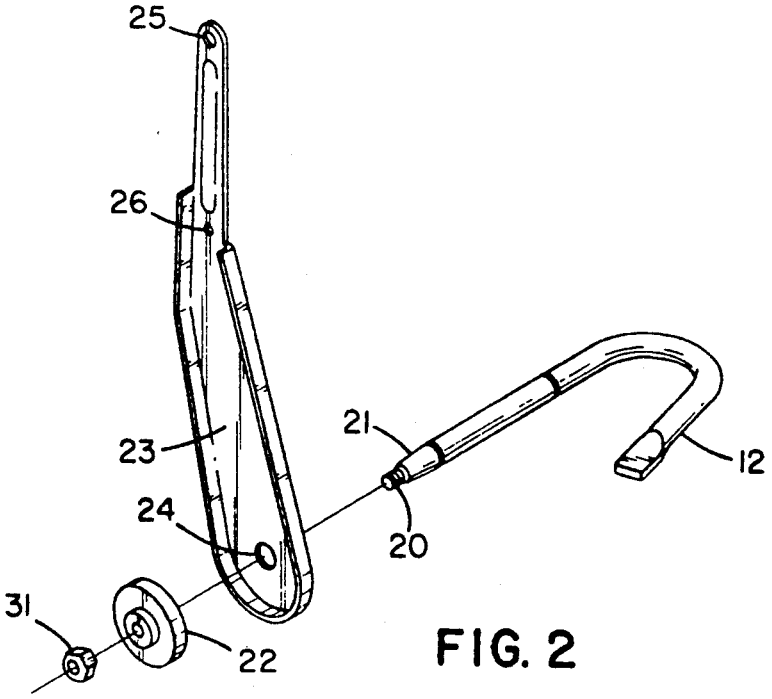
FIG. 2 is an exploded view of the preferred embodiment of the invention.

In the preferred embodiment of the invention, best shown in FIG. 2, the governor shaft 12 has a circular cross-section and a threaded portion 20 generally located at the end of the governor shaft 12 that extends out of the engine with the threaded portion 20 having a smaller cross-sectional diameter than the remainder of the governor shaft 12. Directly adjacent to the threaded portion 20 is a tapered portion 21 that is frusto-conical in shape and converges from the remainder of the governor shaft 12 to the threaded portion 20.

The governor arm 13 is comprised of a hub portion 22 and an arm portion 23 having first and second ends. The arm portion 23 has a first aperture 25 located at the arm portion 23 second end that is arranged and configured to allow the insertion of the linkage 14 which connects the governor arm 13 to the carburetor valve 15 and a centrally located second aperture 26 arranged and configured to allow the insertion of one end of the governor spring 16. The arm portion 23 also has a third aperture 24 located at the arm portion 23 first end that is arranged and configured to allow the insertion of the extension 27 of the hub portion 22.

Figure 4:
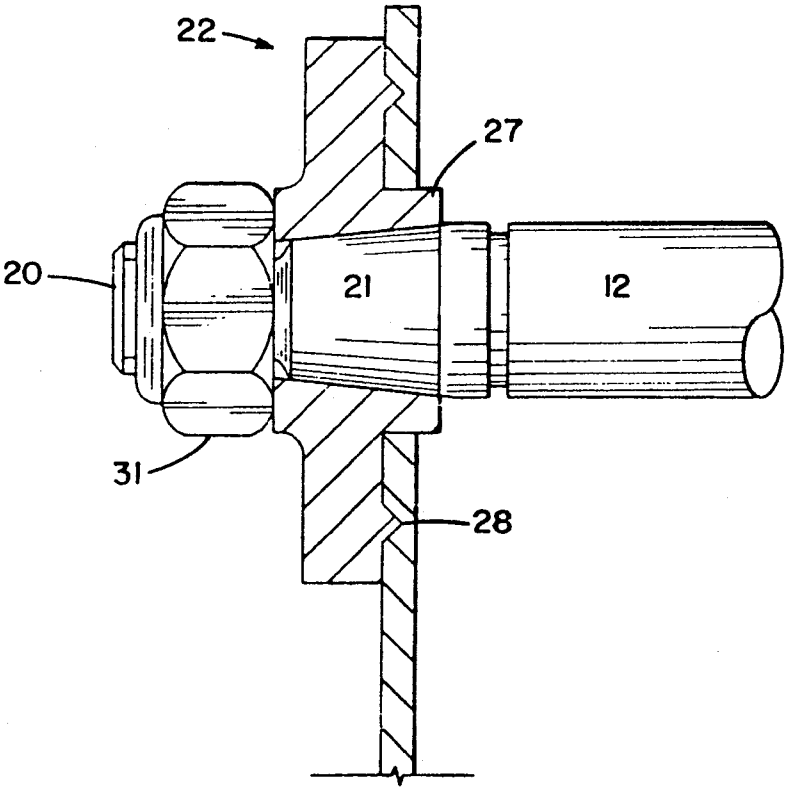
FIG. 4 is a side elevation of the preferred embodiment with portions broken away.
Figure 5:
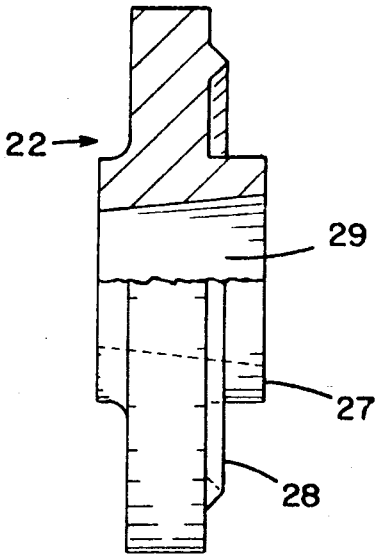
FIG. 5 is a side elevation of the hub portion used in the preferred embodiment with portions broken away.

The hub portion 22, best shown in FIGS. 4 and 5, is circular in shape and generally equal in thickness to the length of the tapered portion 21 of the governor shaft 12. The hub portion 22 also comprises a generally cylindrical extension 27 that is arranged and configured to be inserted into the third aperture 24 of the arm portion 23. A generally circular welding ring 28 is generally located on the hub portion 22 between the extension 27 and the outer diameter of the hub 22. A tapered aperture 29 is generally located in the center of the hub portion 22 with the largest diameter of the taper aperture 29 being located at the extension 27. The minimum diameter of the tapered aperture 29 is sized to be greater than the diameter of the threaded portion 20 of the governor shaft 12, but smaller than the diameter of the tapered portion 21. A relatively steep taper, 2.5 inches per foot, was chosen for the preferred embodiment to assure the easy removal of the governor arm 13 during repairs or engine adjustments.

The hub portion 22 is machined from hardened steel to assure that the shape of the tapered aperture 29 will correspond to the shape of the tapered portion 21 of the governor shaft 12 and to provide the strength needed for the insertion and securing of the tapered portion 21 of the governor shaft 12. The arm portion 23 is made of stamped sheet metal to reduce the cost and weight of the governor arm 13.

Those skilled in the art would recognize that the governor arm 13 could be made as a single piece. However, the preferred embodiment utilizes two pieces to reduce the weight and cost of the governor arm 13. In addition, the two-piece arrangement used in the preferred embodiment acts to centralize the weight of the governor arm 13 about the connection with the governor shaft 12 reducing the inertia of the governor arm 13 to assure a fast response by the governor system 10 to any engine speed changes.

The governor arm 13 is assembled by first inserting the extension 27 on the hub portion 22 into the third aperture 24 on the arm portion 23. The hub portion 22 is then clamped to the arm portion 23 forcing the welding ring 28 against the arm portion 23. A resistance welder is then applied to the governor arm 13 creating a welded connection between the welding ring 28 and arm portion 23. Those skilled in the art would recognize that other methods of connecting the hub portion 22 to the arm portion 23 are also available.

The preferred method of assembling the governor system 10, FIG. 3, starts by inserting the governor shaft 12 into the engine block 19 before the engine block 19 is assembled. After the engine block 19 is assembled, the governor arm 13 is then loosely placed on the governor shaft 12 by sliding the tapered aperture 29 over the threaded portion 20 of the governor shaft 12 until the tapered aperture 29 makes contact with the tapered portion 21. One end of the linkage 14 is then connected to carburetor valve 15 and the other end of the linkage 14 is connected to the governor arm first aperture 25. The governor spring 16 is then attached to the control plate 17 and the governor arm second aperture 26 thereby causing the governor arm 13 to be rotated until the carburetor valve 15 is in its maximum open position. The system is secured by tightening a torque-prevailing nut 31 on the threaded portion 20 which causes the governor shaft 12 to rotate to its maximum speed position and forces the tapered aperture 29 into engagement with the tapered portion 21, FIG. 4.

Although characteristics and advantages together with details for structure, materials, function and process steps, have been described in reference to a preferred embodiment herein, it is understood that the disclosure is illustrative. To that degree, various changes made, especially to the matters of shape, size and arrangement, to the full extent extended by the general meaning of the terms in which the appended claims are expressed, are within the principles of the present invention.

What is claimed is:

1. A governor shaft/governor arm joint used in a governor linkage of an engine; comprising:

a) a governor shaft with first and second ends having a tapered portion generally located near said first end;

b) a governor arm with first and second ends having a tapered aperture generally located near said first end that is arranged and configured to allow the insertion of said tapered portion of said governor shaft into said tapered aperture; and c) a means for securing said governor shaft to said governor arm that forces said tapered portion of said governor arm into engagement with of said tapered aperture.

2. A governor shaft/governor arm joint according to claim 1 wherein said securing means comprises:

a) a threaded portion generally located on said governor shaft between said first end and said tapered portion that is arranged and configured to allow said threaded portion to be inserted through said tapered aperture whereby said threaded portion extends out of said governor arm when said tapered portion is in contact with said tapered aperture; and b) a nut arranged and configured to fit on said threaded portion whereby said tapered portion is forced into engagement with said tapered aperture as said nut is tightened.

3. A governor shaft/governor arm joint according to claim 2 wherein said nut is a torque prevailing nut.

4. A governor shaft/governor arm joint according to claim 1 wherein said governor arm is further comprised of an arm portion, a hub portion having said tapered aperture located in said hub portion and means for securing said arm portion to said hub portion.

5. A governor shaft/governor arm joint according to claim 4 wherein said arm portion is made of sheet metal and said hub portion is made of steel having a thickness generally equal to the length of said tapered portion of said governor shaft.

6. A governor shaft/governor arm joint according to claim 4 wherein said means of securing said hub portion to said arm portion is a welded connection.

7. A governor shaft/governor arm joint used in a governor linkage of an engine; comprising:

a) a governor shaft with first and second ends having a threaded portion generally located at said first end and a tapered portion generally located adjacent to said threaded portion that converges from said governor shaft to said threaded portion;

b) a governor arm with first and second ends having an arm portion, a hub portion generally located near said first end and a tapered aperture located in said hub portion that is arranged and configured to allow the insertion of said threaded portion through said governor arm allowing said threaded portion to extend out of said governor arm when said tapered portion of said governor shaft makes contact with said tapered aperture; and c) a nut arranged and configured to fit on said threaded portion whereby said tapered portion is forced against said tapered aperture as said nut is tightened.

8. A method of assembling a governor system for a reciprocating internal combustion engine that automatically zeroes out the tolerances of the system comprising the steps of:

a) inserting a governor shaft into an engine block, said governor shaft having first and second ends with a tapered portion generally located near said first end, whereby said second end is aligned with said governor on the interior of the engine and said tapered portion is on the exterior of the engine;

b) rotating said governor shaft until said governor shaft is in its maximum speed position;

c) placing a governor arm onto said first end of said governor shaft, said governor arm having first and second ends with a first aperture, a second aperture and a tapered aperture generally located at said first end that is arranged and configured to allow the insertion of said tapered portion of said governor shaft into said tapered aperture;

d) attaching a linkage between a carburetor valve and said first aperture of said governor arm;

e) attaching a governor spring between a throttle plate and said second aperture of said governor arm thereby causing said governor arm to be moved toward said throttle plate until said carburetor valve is at its maximum open position; and f) applying a means for securing said governor shaft to said governor arm that forces said tapered portion of said governor shaft into engagement with said tapered aperture.

9. A method of assembling a governor system according to claim 8 wherein said means for securing said governor shaft to said governor arm comprises:

a) placing a torque prevailing nut on a governor shaft having a threaded portion generally located on said governor shaft between said first end and said tapered portion that is arranged and configured to allow said threaded portion to be inserted through said tapered aperture whereby said threaded portion extends out of said governor arm when said tapered portion is in contact with said tapered aperture; and b) tightening said torque prevailing nut whereby said torque prevailing nut rotates said governor shaft to its maximum speed position and said tapered portion is forced into engagement with said tapered aperture.

* * * * *